US010226688B1

(12) United States Patent
Camaratta, Jr.

(10) Patent No.: US 10,226,688 B1
(45) Date of Patent: Mar. 12, 2019

(54) CHESS PIECES WEIGHTED WITH POWDERED METAL

(71) Applicant: Frank A. Camaratta, Jr., Huntsville, AL (US)

(72) Inventor: Frank A. Camaratta, Jr., Huntsville, AL (US)

( * ) Notice: Subject to any disclaimer, the term of this patent is extended or adjusted under 35 U.S.C. 154(b) by 603 days.

(21) Appl. No.: 14/470,609

(22) Filed: Aug. 27, 2014

(51) Int. Cl.
*A63F 3/00* (2006.01)

(52) U.S. Cl.
CPC ..... *A63F 3/00697* (2013.01)

(58) Field of Classification Search
CPC ..... A63F 3/00697; A63F 3/00694; A63F 7/0088; A63F 9/0468
USPC ..... 273/239, 260, 288, 290, 291
See application file for complete search history.

(56) References Cited

U.S. PATENT DOCUMENTS

| | | | | |
|---|---|---|---|---|
| 3,782,726 | A * | 1/1974 | Huffman et al. | 273/108.41 |
| 3,863,930 | A * | 2/1975 | Uvanni | A63F 3/00697 273/291 |
| 4,145,052 | A * | 3/1979 | Janssen | A63B 53/04 473/338 |
| 5,443,270 | A * | 8/1995 | Loritz | 273/290 |
| 5,662,326 | A * | 9/1997 | Gebran | 273/239 |
| 5,895,321 | A * | 4/1999 | Gassies et al. | 463/29 |
| 7,347,422 | B1 * | 3/2008 | Wadowski | A63F 3/00697 273/236 |
| 2005/0230915 | A1 * | 10/2005 | Alvarez | A63F 3/00697 273/288 |
| 2007/0105616 | A1 * | 5/2007 | Chapet et al. | 463/25 |
| 2007/0278314 | A1 * | 12/2007 | Chapet | 235/492 |
| 2011/0018715 | A1 * | 1/2011 | Lee | G06K 19/047 340/572.7 |

* cited by examiner

*Primary Examiner* — Vishu Mendiratta
(74) *Attorney, Agent, or Firm* — Simpson & Simpson, PLLC

(57) ABSTRACT

A weighted chess piece, comprising a base having a first cavity and a second cavity therein, wherein the first cavity is filled with loose particles of metal and the second cavity contains an electronic sensor.

9 Claims, 6 Drawing Sheets

Fig. 6
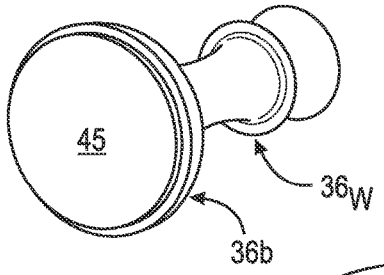
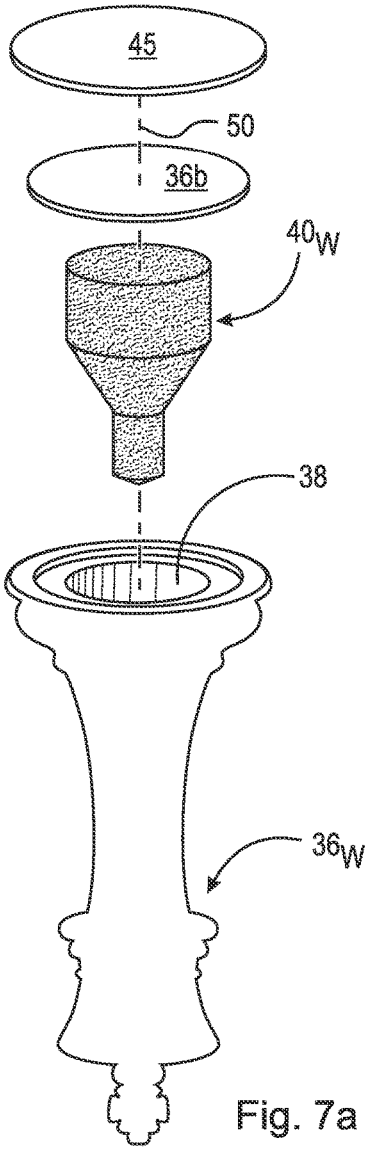
Fig. 7a
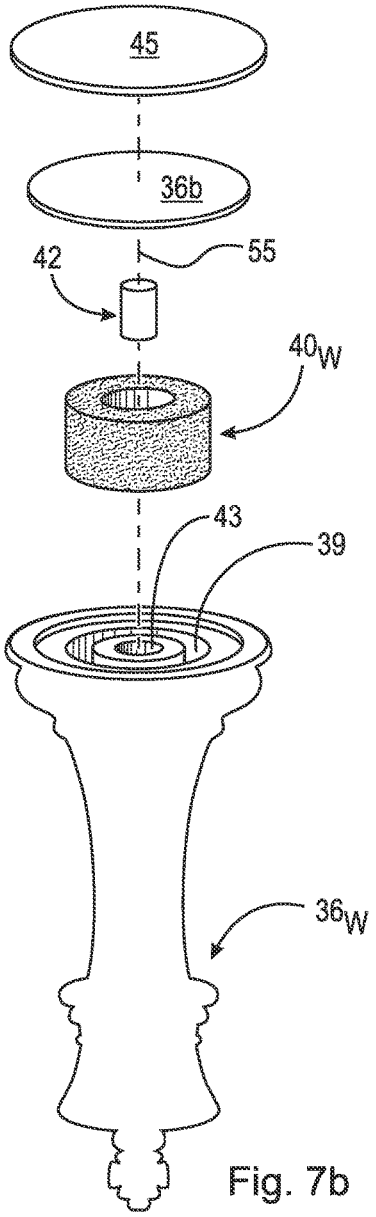
Fig. 7b

CHESS PIECES WEIGHTED WITH POWDERED METAL

FIELD OF THE INVENTION

The present invention relates generally to the game of chess, more specifically to a method of weighting chess pieces and to pieces made by the method, and, even more specifically, to a method of weighting chess pieces in such a way that the pieces made by the method are far less likely to crack and also may include an electronic sensing component which functions without interference with the weighting material.

BACKGROUND OF THE INVENTION

Chess is a two-player strategy board game played on a chess board, a checkered game board with 64 squares arranged in an eight-by-eight grid. It is one of the world's most popular games, played by millions of people worldwide in homes, parks, clubs, online, by correspondence, and in tournaments.

Each player begins the game with 16 pieces: one King, one Queen, two Rooks, two Knights, two Bishops, and eight Pawns. One player plays with "white" pieces, while the other player plays with "black" pieces, although the pieces may not actually be black and white in color. The two different sets of pieces of each player are always in contrasting colors. Each of the six piece types moves differently. Pieces are used to attack and capture the opponent's pieces, with the objective to "checkmate" the opponent's King by placing it under an inescapable threat of capture. In addition to checkmate, the game can be won by the voluntary resignation of the opponent, which typically occurs when too much material is lost, or if checkmate appears unavoidable. A game may also be won when one player runs out of time as measured by a chess clock. It is also possible for a game to result in a draw, or stalemate, where neither player wins.

The chess pieces themselves are made of many different materials, including, but not limited to plastic, wood, ceramic, ivory, bone, stone, glass, marble, and metal (including precious metals). Common woods used to make chess pieces include Boxwood, Ebony, Rosewood, Sandalwood, Sheesham, Maple, Palm, Cedar, African padauk, and Olive wood. Virtually any wood can be used to make chess pieces, although some are better than others due to weighting and cracking concerns discussed further below. Ebony and Rosewood are among the most common woods used for high end chess sets. They are very expensive woods. Thus, the sets made out of these woods are very desirable.

Chess sets made of metal are mainly made of alloys of zinc, tin, copper and aluminum. Pewter, another alloy of tin (about 85% to 95%) and copper (about 1% to 5%) are also used to make good metal chess sets. In appearance, pewter has the appearance of silver and provides a high profile look. Apart from the mentioned metals, alloys like bronze (copper and tin) and brass (copper and zinc) are also used to make metal chess sets. Marble chess pieces are made of either artificial marble or pure marble. The making of stone chess sets is done in the same process as marble. Chess sets are also made of deer antler, camel bone and ivory. The United States banned the import of ivory in 1989, and other countries have followed suit. Ivory chess sets are usually both rare and valuable.

During the first half of the 19th century, a surge in the global popularity of chess brought about the demand for a uniform model of chess pieces. While the variety and styles of chess pieces that were in use at the time were extensive, they were decorative in nature and considered unsuitable for play. Chess has historically been enjoyed by the wealthy, a fact that is reflected in the artistic designs of chess sets that dominated the marketplace. While aesthetically beautiful, the chess pieces of the period were not very practical. The chess pieces were expensive to produce, cumbersome to use, prone to tipping over and had such ornate details that they were unable to withstand the wear and tear of regular use. However, the greatest disadvantage of these chess sets was the lack of uniformity of the pieces within a chess set—a player's unfamiliarity with a particular chess set could affect the outcome of the game and were prone to tipping over due to poor stability. Complaints such as these led to the search for a standard design of chess pieces. On Sep. 1, 1849, An Ornamental Design for a Set of Chess-Men (No. 58607) was registered by Mr. Nathaniel Cook under the British Ornamental Designs Act of 1842.

Our research has lead us to conclude that the basis for this new design of chess pieces was the Northern Upright Chess Set, © 1840, by Lord John Hay. Complaints about the contemporary designs of chess pieces were well established in chess circles. By starting with an extremely popular yet highly artistic chess set, Mr. Cook was able to focus his energies solely on correcting those deficiencies. The ornate features that were most susceptible to damage were removed, resulting in a chess set that was durable and less expensive to produce. The diameter of the bases was widened for increased stability and the chess pieces were weighted with lead for ballast. Before the commercial launch of these new chess pieces, Mr. Cook convinced Howard Staunton to lend his prestigious name to the new design. Mr. Staunton was England's most celebrated chess personality and the unofficial World Champion. The Staunton Pattern Chessmen, as they were officially known, became commercially available on Sep. 29, 1849 and quickly became the world standard of chess pieces. Their lower production cost brought chess to the masses and did much to popularize the game. Its clean, simple design has never been equaled—the Staunton pattern chess set looks as modern today as it did upon its introduction more than 150 years ago. As a result, the Staunton style chessmen is the standard used in tournament play today, and is most common in club/casual play as well.

Chess designs are often identified using the Camaratta codex (named for the present inventor) by the appearance of the Knight, and enjoy interesting names, including that of Nathaniel Cook himself, as well as many famous players, ("Cook", "Morphy", "Harrwitz", "Paulsen", "Anderssen", "Anderssen drop jaw", "Steinitz", "Tarrasch", "Zukertort", "Lasker", "Pre-Hartston", "Hartston", "Marshall", "Nimzovich", "Broadbent" and "Lessing".) More recent sets are known by names of cities where they were produced (e.g., "Zagreb", "Reykjavik"), in honor of modern champions ("Capablanca", "Marshall", "Fischer") or to commemorate certain important tournaments ("Fischer-Spassky", "Sinquefield Cup").

Frank A. Camaratta, Jr., the present inventor, is an internationally recognized expert in antique Staunton and other playing sets. He has been a serious collector and researcher of antique playing chess sets, their design and history, since 1986. This research, which began in 1989, was centered on Jaques and other Staunton chessmen and quickly expanded into Pre-Staunton playing sets. In 1990, he founded The House of Staunton, offering the finest manufactured and antique chess equipment in the Staunton pattern. He has also written several articles and given numerous lectures on the subject of Staunton chessmen. His research includes categorizing the various Staunton designs and their evolution starting with their introduction in September of 1849. He is widely known and respected as a designer and manufacturer of chessmen. Mr. Camaratta's chess pieces, available from The House of Staunton, are well known and used in some of the most prestigious chess tournaments in the world, such as the U.S. Chess Championship, and the Sinquefield Cup (a tournament that usually boasts the highest rated players in the world, including World Champion Magnus Carlsen.)

A long-felt problem associated with the manufacture of chessmen has to do with weighting them, and with problems that weighting causes. Chess players like to play with "heavy" pieces. It is common, then, for both plastic and wood pieces to be weighted. Wooden chessmen crack because manufacturers use lead, steel, plaster of Paris, and concrete in solid form to add ballast to the chessmen to improve their stability and tactile qualities during play. Unweighted chessmen almost never crack, regardless of the size of the piece or the species of wood used. It has very little to do with how well the wood is seasoned. Poorly seasoned wooden chessmen will usually tend to warp or bend rather than crack. The cracks almost always emanate from the base outward, then upward as the crack begins to open.

The actual mechanism behind the tendency of weighted wooden chessmen to crack is shrinkage due to loss of moisture in dry environments combined with the presence of the solid weighting material which hinders this contraction. This loss of moisture can be caused by climatic and geographic factors as well as the type of heat used during the winter months. The mechanics of the problem can be explained by looking at what happens when a chessman loses moisture. To add weight to a chess piece, a hole is bored into the base and a solid slug of metal, usually lead, is inserted into the base. There are two methods by which this can be accomplished. First, molten lead can be poured into the cavity. This is the most common method employed today by manufacturers of chessmen in India. It has the major disadvantage of scorching the wood locally and drastically changing its material properties. This method can also significantly embrittle the wood. Second, the weighting media can be cast or machined to shape outside the wooden cavity, then glued or screwed into place. This would be a good solution if the manufacturing process used could control the tolerances in the wood and maintain a uniform "gap" between the wood and the weight. This has been marginally successful in preventing cracking.

When the wood loses moisture, it shrinks That means the diameter of the bore gets smaller. However, the weighting material, which is a solid cylindrical slug, does not shrink. So, the wood needs to "stretch" in order to fit around the weight. This induces hoop strains in the wood. The second mechanism which works in concert with the "stretching" is the presence of small flaws which are dispersed throughout any piece of wood. Then, these flaws, which can't be seen with the naked eye, appear at the outer edge of the bore, and become potential crack initiation sites.

If the wood is reasonably compliant and has a low notch sensitivity, or if there is sufficient space between the lead weight and the inside edge of the bore, these induced hoop strains can be kept relatively low. Certain woods, like Rosewood (genus *Dalbergi*, a large species of small to medium-size trees) and its close relatives like Cocobolo and African Blackwood, are relatively compliant (they have a relatively shallow stress/strain curve), have good notch sensitivity, and can stretch without inducing hoop strains sufficient to exceed its modulus of rupture. Think of a rubber band or some such material. It can stretch with little effort. However, in certain very strong woods, like Ebony, which are very notch-sensitive, its strength and steep stress/strain curve work against it. It has very little "give", so it takes high hoop strains to force the Ebony base to conform to the solid lead weight. If those strains exceed the modulus of rupture, of if they are sufficient to cause those minute flaws to grow into fatigue cracks over time, the wood will fail. Boxwood (actually Indian Whitewood), which is almost universally used for the light colored chessmen, is relatively forgiving in this respect, but not quite as good as woods in the Rosewood family. In all cases, however, the praxis of pouring molten lead into the base cavity of the chessmen exacerbates this problem by significantly altering the mechanical properties of the wood, making it more brittle, and opening the minute fissures (flaws) normally present.

Another problem with weighting chess pieces stems from the fact that black pieces in a chess set are traditionally made of a wood that is denser than that used for the white pieces. For example, Ebony has a higher density than Boxwood. This means that, if a manufacturer uses the same unitary weight (e.g., a lead slug) to weight each piece, each black piece will likely weigh more than its white counterpart. This is not desired and another problem to be solved by the present invention.

Since 1972, when Bobby Fischer defeated Boris Spassky to become the World Chess Champion, the game of chess has enjoyed a surge in popularity that continues even today. As computer technology and the Internet have evolved, chess players and aficionados are now able to watch top Grand Masters play in international tournaments via the Internet. Sophisticated sensory chess boards are able to sense the location of each piece on the board, transmit these locations to a computer, and then broadcast the game, move by move, over the Internet. These high-level games are usually accompanied by live expert commentary by Grand Masters and International Masters.

One such manufacturer of a sensory chess board is DGT Projects, B.V., of Enschede, Netherlands. This company's products, known as "DGT Boards" are commonly used in many top level chess tournaments. In 2001, U.S. Pat. No. 6,168,158 (Bulsink) issued for an invention entitled, "Device for Detecting Playing Pieces on a Board," incorporated herein in its entirety. The patent was assigned to DGT Projects, B.V. The patented invention uses chess pieces which include a resonance coil (sensor) embedded in each piece, and a board having a plurality of transmit and receive resonance coils embedded in the board which, together with an electronic circuit and software, are able to detect the position and identity of each piece on the board, and display it on a computer monitor. That is, the DGT Board and system, described in the patent, is able to correctly identify each piece, white and black, on each of the 64 squares on a chess board.

A problem with the DGT technology is that it has heretofore been thought impossible to weight the DGT chess pieces in such a way that does not interfere with the sensor/coil communication between the pieces and the coils embedded in the board. The traditional weighting material, lead, is a metal, and eddy currents on the surface of the lead weighting element create an electromagnetic field that interferes with the transmission of the signals between piece and board. It is not obvious that these pieces can be weighted with a metal. After all, Faraday's law would seem to suggest to an electrical engineer and chess piece designer alike that metal weights in the base of a "sensory" chess piece would induce current and generate electromagnetic fields that would interfere with communication between the sensor and board. As a result, chess pieces that are compatible with the DGT sensory chess board are notoriously light in weight, as shown in the table below:

| Chess Pieces | Black King Weight | White King Weight | Set Weight |
|---|---|---|---|
| DGT Classic Chess Pieces | 1.4 oz. | 1.3 oz. | 23.6 oz. |
| DGT Ebony Chess Pieces | 1.6 oz. | 1.2 oz. | 24.8 oz. |

By comparison, a traditional weighted wood chess set, such as the Frank Camaratta Signature Series Luxury Chess Set, with a 4.4" King, and two extra Queens, made of Boxwood and Ebony and distributed by the House of Staunton, with only the Ebony pieces weighted by the method of the present invention, weighs 86 ounces (not including the extra Queens). Moreover, the House of Staunton Imperial Set, with a 3.5" King, and two extra Queens, which is DGT-Enabled, meaning that each piece includes an electronic sensor (coil) that can communicate with a DGT Sensory Chess Board, where each piece is weighted according to the method of the present invention, weighs 54 ounces (again, not including the extra Queens). The weight of the black King in this DGT-Enabled set is 3.7 ounces, and the white King is 3.6 ounces, whereas the heaviest King heretofore available for this set from DGT Projects is 1.6 ounces.

In summary, then, wooden Staunton Style chessmen have been made and used for at least 165 years, and other styles of wooden chessmen have been known and used for long before this. The problem of cracking wooden chess pieces has been well-known and ever-present for as long as wood chess pieces have been made, and yet no one, before now, has solved the problem of weighting wood chess pieces in such a way as to prevent cracking. Moreover, it has always been known that the species of wood traditionally used to make black chess pieces is traditionally more dense than wood used to make white pieces, and that white pieces are usually lighter in weight than black pieces in any given set. Thus, a long-felt need has existed for a method of weighting chess pieces that prevents cracking of the pieces, does not interfere with the electronics in sensory type chess boards, and equalizes the weights of black pieces versus white pieces in any given set. A need has obviously also existed for the pieces produced by this method.

BRIEF SUMMARY OF THE INVENTION

The present invention broadly comprises a method of weighting a chess piece, comprising the steps of creating a first cavity in a base of the chess piece, and filling the first cavity with a powdered metal. The method also includes the step of creating a second cavity in the base, and filling the second cavity with an electronic sensor so that the piece may communicate electronically with a sensory chess board. The invention also includes a method of weighting a set of white and black chess pieces made of different species of wood in such a way that the total weight of the white pieces is approximately the same as the total weight of the black pieces. The invention also includes a chess piece made from the method, as well as sets of white and black pieces made from the method.

It is a general object of the present invention to provide a method of weighting chess pieces in a manner that prevents cracking of the pieces and also accommodates electronic sensors embedded in the chess pieces to function without interference with the weighting material.

It is also an object of the present invention to provide a chess piece made in accordance with the method of the invention.

It is a further object of the present invention to provide a method of weighting a set of white and black pieces with a metal powder, using a different grain size for the black pieces than for the white pieces to compensate for the difference in density between the white and black woods used for the respective pieces, such that the total weight of the black pieces will be approximately the same as the total weight of the white pieces.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which:

FIG. 6 is bottom perspective view of the King shown in FIG. 2*a;*

FIG. 7*a* is an exploded perspective view of the King shown in FIG. 2*a* except inverted;

FIG. 7*a* is an exploded perspective view of the King shown in FIG. 2*a* except inverted;

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it should be understood that this invention is not limited to the particular methodology, materials and modifications described and, as such may, of course, vary. It should also be understood that the terminology used herein is for the purpose of describing particular aspects only, and is not intended to limit the scope of the present invention as claimed, which is limited only by the appended claims.

Unless defined otherwise, all technical and scientific terms used herein have the same meaning as commonly understood to one of ordinary skill in the art to which this invention pertains. In this patent, the terms "chess piece", "chessman", and their derivatives are used interchangeably. Although any methods, devices or materials similar or equivalent to those described herein can be used in the practice or testing of the invention, the preferred methods, devices, and materials are now described.

Figure 1:
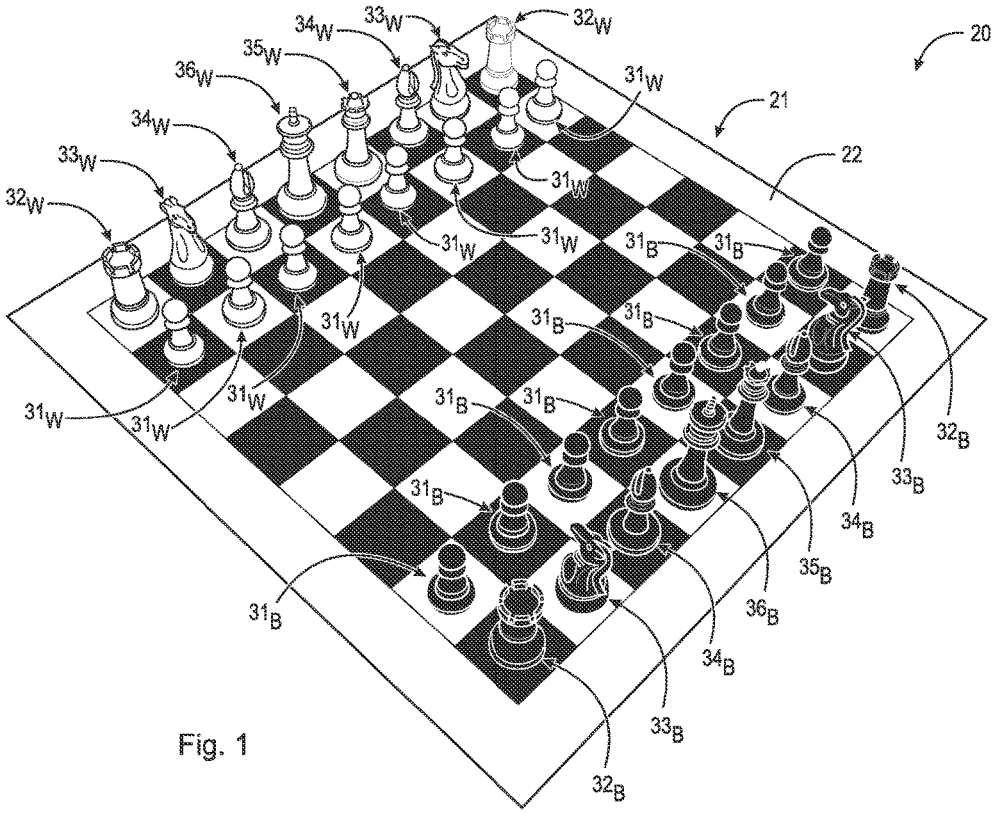
FIG. 1 is a perspective view of a chess set embodying the invention.

In the description that follows, the subscript "$_B$" is used to refer to black chess pieces and the subscript "$_W$" is used to refer to white chess pieces. Adverting now to the figures, FIG. 1 is a perspective view of chess set 20. Chess set 20 broadly comprises board 21, Pawns $\mathbf{31}_B$ and $\mathbf{31}_W$, Rooks $\mathbf{32}_B$ and $\mathbf{32}_W$, Knights $\mathbf{33}_B$ and $\mathbf{33}_W$, Bishops $\mathbf{34}_B$ and $\mathbf{34}_W$, Queens $\mathbf{35}_B$ and $\mathbf{35}_W$, and Kings $\mathbf{36}_B$ and $\mathbf{36}_W$. The arrangement of chess set 20 is well known to a person having ordinary skill in the art and is representative of the starting positions for a game of chess. Pawns $\mathbf{31}_B$ and $\mathbf{31}_W$, Rooks $\mathbf{32}_B$ and $\mathbf{32}_W$, Knights $\mathbf{33}_B$ and $\mathbf{33}_W$, Bishops $\mathbf{34}_B$ and $\mathbf{34}_W$, Queens $\mathbf{35}_B$ and $\mathbf{35}_W$, and Kings $\mathbf{36}_B$ and $\mathbf{36}_W$ are arranged on surface 22 of chess board 21. In a preferred embodiment, chess board 21 is a sensory chess board which is operatively arranged to detect the precise location of each piece on the board and communicate these locations to a computer. One such board, known to many chess players as a "DGT Board" is manufactured by Digital Game Technologies (DGT) of Enschede, Netherlands. It should be appreciated, however, that the use of any type of chess board can be used with the pieces claimed in this patent. Surface 22 of board 21 is preferably smooth and level to allow for ease of movement of the chessmen. As is well known, a chess board comprises 64 squares of alternating colors, arranged in 8 ranks and 8 files. The ranks are identified in an algebraic system by the letters "a" through "h" and the ranks by the numbers "1" through "8". Each square on the board is traditionally and uniquely identifiable using this algebraic method. For example, "e4" refers to the square on the board where the "e" file and "$4^{th}$" rank intersect. If a player pushes Pawn $\mathbf{31}_W$, which initially is in front of King $\mathbf{36}_W$, two squares forward, he or she is said to have moved the Pawn to the "e4" square.

Figure 2A:
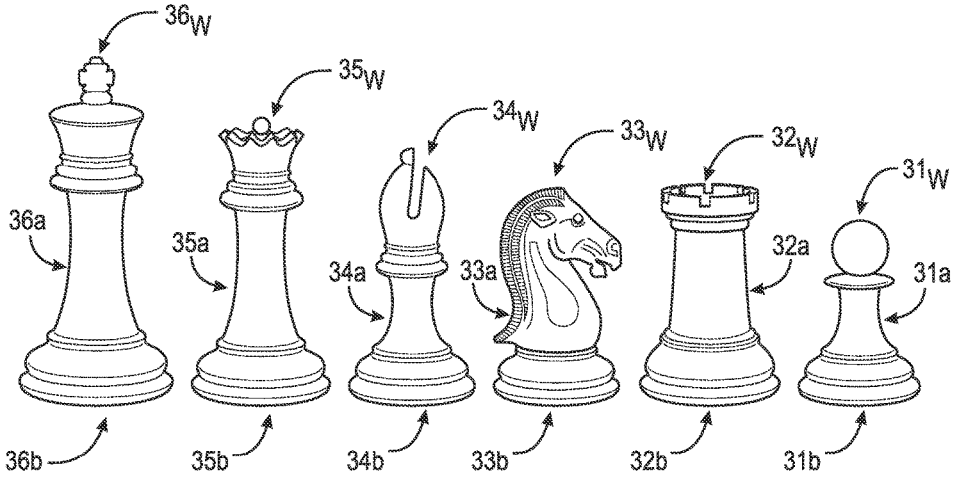
FIG. 2*a* is a side elevational view of pieces of the chess set shown in FIG. 1.
Figure 2B:
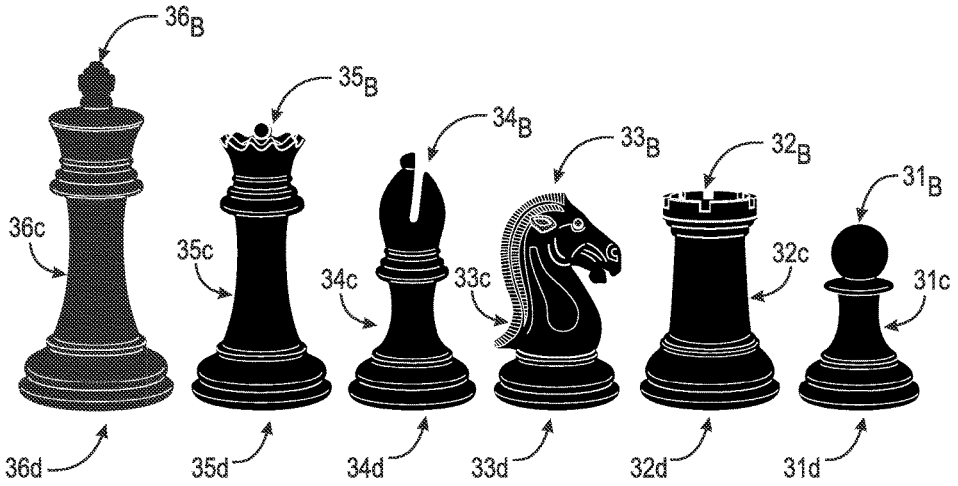
FIG. 2*b* is a side elevational view of pieces of the chess set shown in FIG. 1.

FIGS. 2*a* and 2*b* are side elevational views of the chessmen included within chess set 20. White pieces are shown in FIG. 2*a* and black pieces are shown in FIG. 2*b*. Specifically, King $\mathbf{36}_W$ comprises base 36*a* and seal 36*b*, Queen $\mathbf{35}_W$ comprises base 35*a* and seal 35*b*, Bishop $\mathbf{34}_W$ comprises base 34*a* and seal 34*b*, Knight $\mathbf{33}_W$ comprises base 33*a* and seal 33*b*, Rook $\mathbf{32}_W$ comprises base 32*a* and seal 32*b*, and Pawn $\mathbf{31}_W$ comprises base 31*a* and seal 31*b*. As shown in FIG. 2*b*, King $\mathbf{36}_B$ comprises base 36*c* and seal 36*d*, Queen $\mathbf{35}_B$ comprises base 35*c* and seal 35*d*, Bishop $\mathbf{34}_B$ comprises base 34*c* and seal 34*d*, Knight $\mathbf{33}_B$ comprises base 33*c* and seal 33*d*, Rook $\mathbf{32}_B$ comprises base 32*c* and seal 32*d*, and Pawn $\mathbf{31}_B$ comprises base 31*c* and seal 31*d*. It is important to note that each seal is removable from its respective base in order to gain access to the inside of each base for purposes of weighting. It should also be appreciated that the diameters of the pieces can vary based on preference and piece type.

Figure 3:
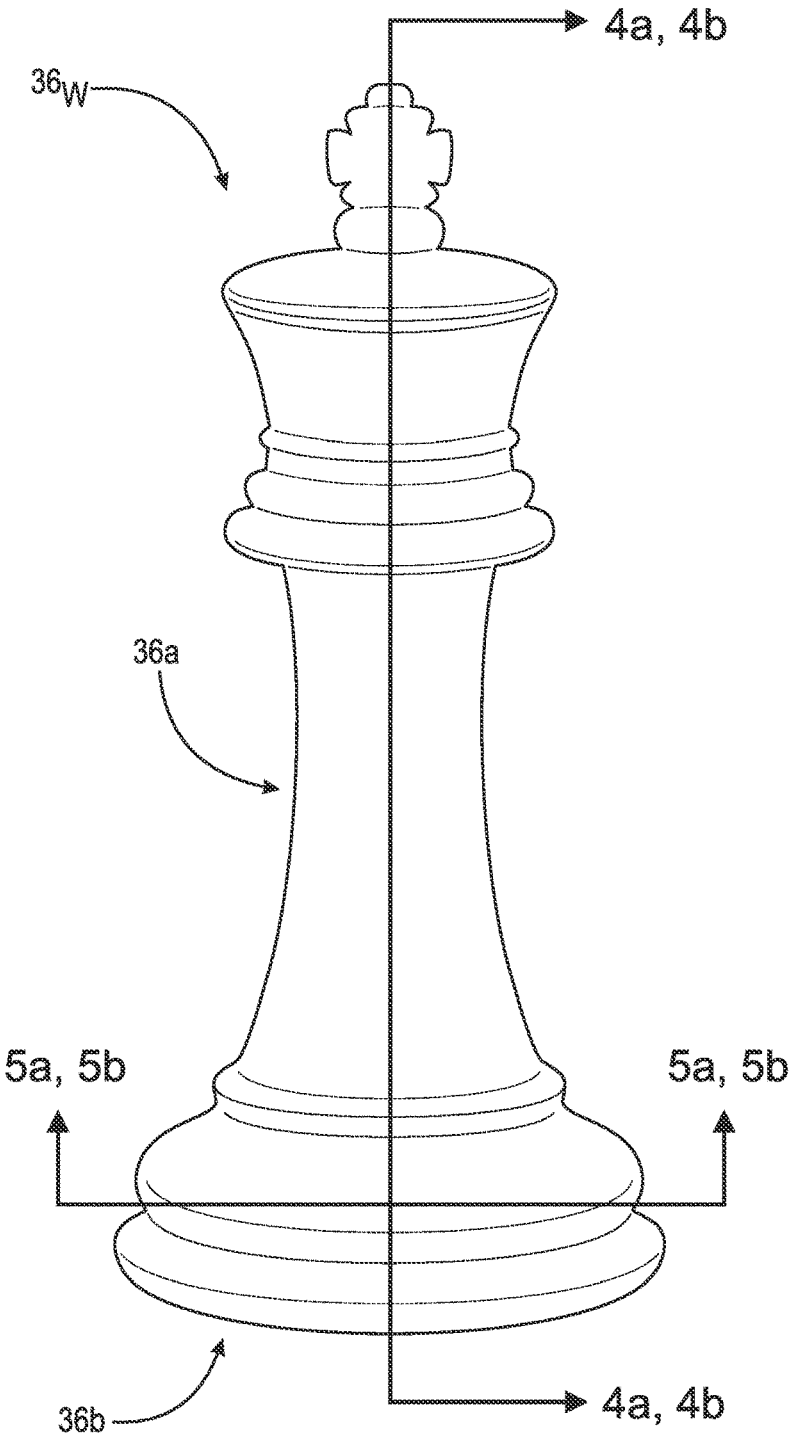
FIG. 3 is a front elevational view of the King shown in FIG. 2*a;*

FIG. 3 is an enlarged perspective view of King $\mathbf{36}_W$. The diameter of seal 36*b* is larger than the width of base 36*a*. Similarly, as depicted in FIGS. 2*a* and 2*b*, the diameters of seals 31*b*, 31*d*, 32*b*, 32*d*, 33*b*, 33*d*, 34*b*, 34*d*, 35*b*, 35*d*, 36*b* and 36*d* are larger than bases 31*a*, 31*c*, 32*a*, 32*c*, 33*a*, 33*c*, 34*a*, 34*c*, 35*a*, 35*c*, 36*a* and 36*c*, respectively. It should be appreciated that the relationship between the diameters of the seals in comparison to the bases of the chessmen helps ensure the chessmen do not tip.

Figure 4A:
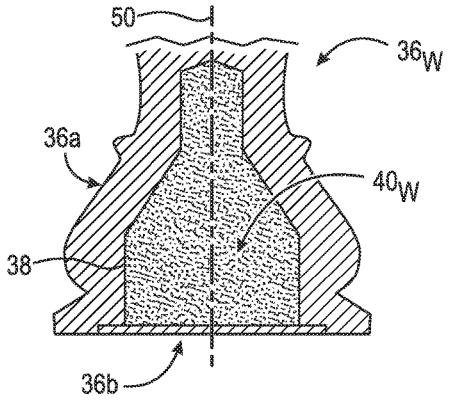
FIG. 4*a* is a cross-sectional view of an embodiment of the invention taken generally along line 4*a*-4*a* in FIG. 3.

FIG. 4*a* is a cross-sectional view of King $\mathbf{36}_W$ taken generally along line 4*a*-4*a* in FIG. 3. In an example embodiment, King $\mathbf{36}_W$ comprises cavity 38 within base 36*a* which can be filled with material $\mathbf{40}_W$ for weighting. Cavity 38 is arranged along longitudinal axis 50 of King $\mathbf{36}_w$. Cavity 38 is a cylindrical partial through-bore drilled into base 36*a* from the center of the bottom of King $\mathbf{36}_W$. The shape of cavity can be any suitable shape. In a preferred embodiment, material $\mathbf{40}_W$ is a tungsten powder which is packed into cavity 38 and held therein by seal 36*b*. The preferable tungsten powder for white chess pieces has an average grain size of approximately 18.0 microns, a porosity of 0.370 and a Scott Density of 160.8 Gm/cu. in. It should be appreciated, however, that the use of different powdered metals is possible and considered within the scope of the invention as claimed. It should also be appreciated that powders of different powdered grain size is also possible. It should be appreciated that King $\mathbf{36}_W$ with material $\mathbf{40}_W$ weighs approximately the same as a comparable white King weighted with lead in a cavity of approximately the same size. Since tungsten is almost twice the density of lead, in powder form, a given volume of lead weighs approximately the same as the same volume of tungsten powder assuming the grain size of the powder is optimized for that purpose. The only other metals that are denser than tungsten are platinum, rhenium, iridium, and osmium. Gold, uranium, and plutonium have about the same density as tungsten. The expense and radioactive nature of these other elements make them largely inappropriate for use in chess pieces.

Figure 4B:
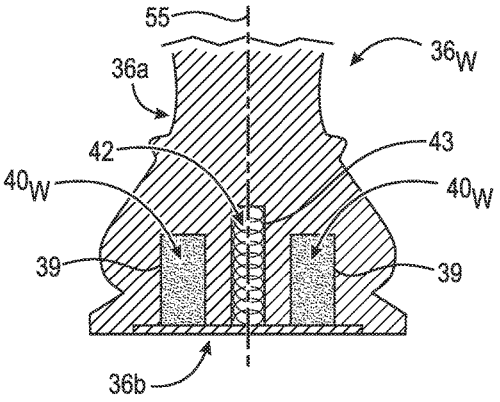
FIG. 4*b* is a cross-sectional view of another embodiment of the invention taken generally along line 4*b*-4*b* in FIG. 3.

FIG. 4*b* is a cross-sectional view of King $\mathbf{36}_W$ taken generally along line 4*b*-4*b* in FIG. 3. King $\mathbf{36}_W$ comprises first cavity 39, second cavity 43, and seal 36*b*. In a preferred embodiment, first cavity 39 is filled with material $\mathbf{40}_W$, for example, a powdered metal like tungsten powder and second cavity 43 contains electronic sensor 42. In a preferred embodiment, first cavity 39 is an annular recess which is carved out of base 36*a* and then filled with material $\mathbf{40}_W$ for purposes of weighting. Preferably, sensor 42 is an induction coil which can interact with a DGT chess board. It should be appreciated that sensor 42 can be secured within second cavity 43 independent of seal 36*b*, for example, by gluing sensor 42 therein. First cavity 39 can be filled with material $\mathbf{40}_W$ and seal 36*b* can be secured to base 36*a* in order to keep material $\mathbf{40}_W$ contained within first cavity 39. It should be appreciated, however, that the use of different sensors is possible and considered to be within the scope of the invention as claimed. For example, sensor 42 could be a radio frequency identification (RFID) tag that interacts with an RFID scanner within a chess board. It should be appreciated, however, that an RFID tag may not necessarily be embedded in a cavity in the base of a chess piece. It may simply be secured to a bottom surface of the piece. Additionally, it should be noted that, in a preferred embodiment, seals 36*a* and 36*b* are made of a similar material. Seal 36*b* can be made from a variety of materials that have the ability to seal with base 36*a*. In order to secure seal 36*b* to base 36*a*, a form of glue or epoxy is used to seal the edge between base 36*a* and seal 36*b*. It should be appreciated that although, in a first embodiment, first cavity 39 is in the shape of an annular recess, first cavity 39 could take the form of other shapes as well (e.g., cylindrically shaped partial through-bores).

Figure 5A:
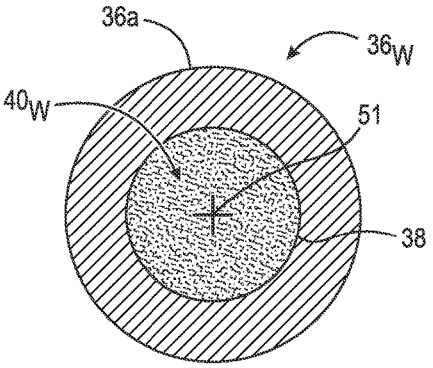
FIG. 5*a* is a cross-sectional view of the King of the invention taken generally along line 5*a*-5*a* in FIG. 3.
Figure 5B:
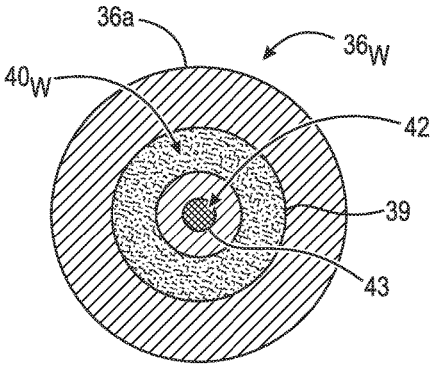
FIG. 5*b* is a cross-sectional view of the King of the invention taken generally along line 5*b*-5*b* in FIG. 3.
Figure 8A:
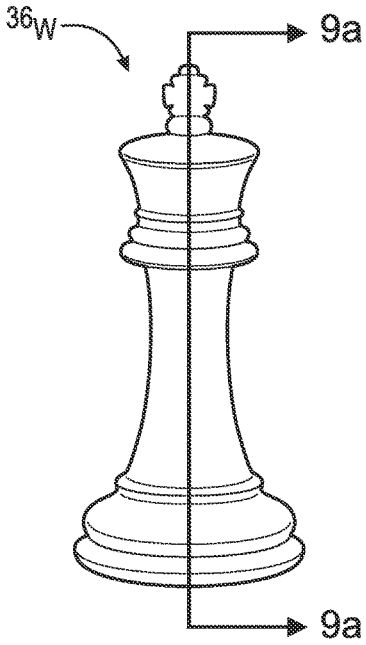
FIG. 8*a* is a front elevational view of a white King of the invention.
Figure 8B:
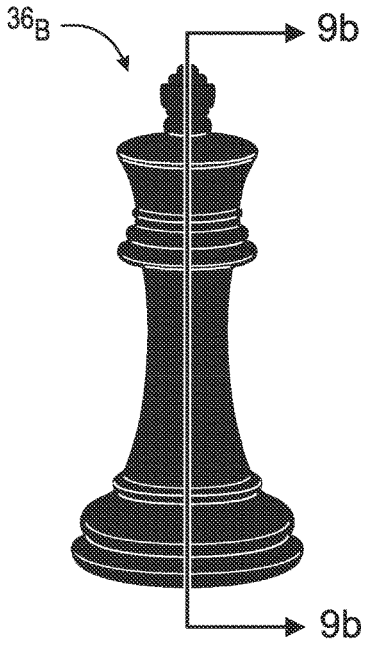
FIG. 8*b* is a front elevational view of a black King of the invention.

FIG. 5*a* is a cross-sectional view of King $\mathbf{36}_W$ taken generally along line 5*a*-5*a* in FIG. 3. Cavity 38 is concentrically arranged within base 36*a* in order to ensure equal weight distribution of material $\mathbf{40}_W$. Cavity 38 surrounds midpoint 51 which is a point on longitudinal axis 50. FIG. 5*b* shows a cross-sectional view of King $\mathbf{36}_W$ taken generally along line 5*b*-5*b* in FIG. 3. First cavity 39 is concentrically arranged about second cavity 43. Both first and second cavities 39 and 43 are arranged about longitudinal axis 55 which runs through the center of second cavity 43. This concentric arrangement ensures proper weight distribution and balance of King $\mathbf{36}_W$. It should be appreciated that the other pieces of chess set 20 are formed with substantially similarly-shaped cavities to accommodate weighting.

FIG. 6 shows a bottom perspective view of King $\mathbf{36}_W$. Pad 45 (which is traditionally made of leather or billiard cloth) is secured to base 36*a* in order to protect board 21 from scratches during use of the pieces and to further seal material $\mathbf{40}_W$ therein. A glue or epoxy is used to fixedly secure pad 45 onto base 36*a*. FIG. 7*a* shows an exploded view of King $\mathbf{36}_W$ inverted to show how King $\mathbf{36}_W$ is weighted as described above with respect to FIGS. 4*a* and 5*a*. Cavity 38 is created in base 36*a* and cavity 38 is filled with material $\mathbf{40}_W$. Thereafter, cavity 38 is sealed with seal 36*b* and pad 45 is applied last. Cavity 38, material $\mathbf{40}_W$, seal 36*b* and pad 45 are concentrically arranged about longitudinal axis 50. FIG. 7*b* shows an exploded view of King $\mathbf{36}_W$ inverted to show how King $\mathbf{36}_W$ is weighted as described above with respect to FIGS. 4*b* and 5*b*. First cavity 39 is created in base 36*a* and second cavity 43 is created in base 36*a* such that second cavity 43 is in a different location than first cavity 39. Electronic sensor 42 is placed within second cavity 43 and material $\mathbf{40}_W$ is filled within first cavity 39. Seal 36*b* is applied to seal material $\mathbf{40}_W$ and optionally sensor 42. Pad 45 is lastly applied atop seal 36*b*. Electronic sensor 42 is operatively arranged to communicate with chess board 21. Preferably, second cavity 43 is concentrically arranged within first cavity 39 however, other arrangements are contemplated. First cavity 39, second cavity 43, material $\mathbf{40}_W$, electronic sensor 42, seal 36*b*, and pad 45 are concentrically arranged about axis 55.

Figure 9A:
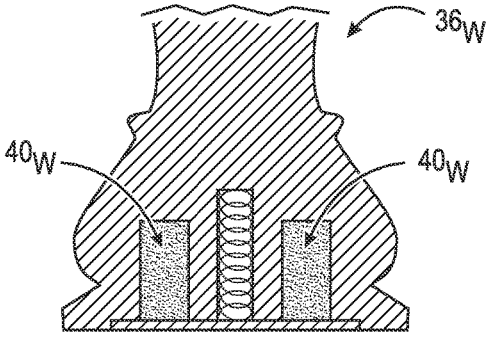
FIG. 9*a* is a cross-sectional view of the white King of the invention shown in FIG. 8*a*; and, FIG. 9*b* is a cross-sectional view of a black King of the invention shown in FIG. 8*b*.
Figure 9B:
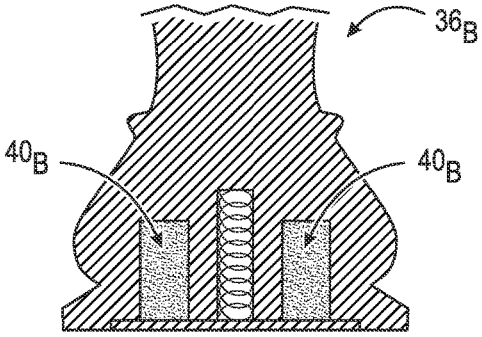

As described above, the white pieces are typically less dense than the black pieces. As shown in FIG. 9*a*, the white pieces are weighted with tungsten powder $\mathbf{40}_W$. Pawns $\mathbf{31}_B$, Rooks $\mathbf{32}_B$, Knights $\mathbf{33}_B$, Bishops $\mathbf{34}_B$, Queen $\mathbf{35}_B$, and King $\mathbf{36}_B$ are manufactured from a material such as, Ebony which is different (more dense) than the material used to manufacture Pawns $\mathbf{31}_W$, Rooks $\mathbf{32}_W$, Knights $\mathbf{33}_W$, Bishops $\mathbf{34}_W$, Queen $\mathbf{35}_W$, and King $\mathbf{36}_W$, such as Boxwood. It is desirable to ensure that Pawns $\mathbf{31}_W$, Rooks $\mathbf{32}_W$, Knights $\mathbf{33}_W$, Bishops $\mathbf{34}_W$, Queen $\mathbf{35}_W$, and King $\mathbf{36}_W$ are weighted in a manner such that their counterparts (Pawns $\mathbf{31}_B$, Rooks $\mathbf{32}_B$, Knights $\mathbf{33}_B$, Bishops $\mathbf{34}_B$, Queen $\mathbf{35}_B$, and King $\mathbf{36}_B$), have similar weights. Hence, a different grain size of tungsten powder is used to weight Pawns $\mathbf{31}_B$, Rooks $\mathbf{32}_B$, Knights $\mathbf{33}_B$, Bishops $\mathbf{34}_B$, Queen $\mathbf{35}_B$, and King $\mathbf{36}_B$. Since Pawns $\mathbf{31}_B$, Rooks $\mathbf{32}_B$, Knights $\mathbf{33}_B$, Bishops $\mathbf{34}_B$, Queen $\mathbf{35}_B$, and King $\mathbf{36}_B$ are already denser than Pawns $\mathbf{31}_W$, Rooks $\mathbf{32}_W$, Knights $\mathbf{33}_W$, Bishops $\mathbf{34}_W$, Queen $\mathbf{35}_W$, and King $\mathbf{36}_W$, Pawns $\mathbf{31}_B$, Rooks $\mathbf{32}_B$, Knights $\mathbf{33}_B$, Bishops $\mathbf{34}_B$, Queen $\mathbf{35}_B$, and King $\mathbf{36}_B$ require less weighting. As shown in FIG. 9*b*, King $\mathbf{36}_B$ is filled with material $\mathbf{40}_B$ which is distinct from material $\mathbf{40}_W$ which is used to fill King $\mathbf{36}_W$. Preferably, material $\mathbf{40}_B$ is crystalline tungsten powder having an average grain size of 50.0 microns, a porosity of 0.350 and a Scott Density of 160.4 Gm/cu. in. Due to the larger size of the granules of material $\mathbf{40}_B$, less material is needed to fill the cavity. It should be appreciated that chessmen can be manufactured from plastic or other materials and weighted using the same method that is described above. Since wooden chess pieces are typically made from different types of wood to represent a "black" and "white" side, the densities of each color wood will inherently be different. Additionally, even the same type of wood, which may come from other parts of the world, may have different densities even though they should be identical. The use of different size granules addresses and solves the problems associated with different types of wood and different densities within a species of wood.

These powder forms of tungsten are preferable because they can be compressed with little resistance. Since a metal powder is not a continuum, significant eddy currents are not generated. Actually, in a sensory chess piece/chess board embodiment, tiny electromagnetic fields are generated about each individual granule, but are not significant, even with millions of granules. Eddy currents in the tungsten powder approach zero as the granule size decreases.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention as claimed.

REFERENCE NUMBERS

20 chess set
21 chess board
22 surface
$\mathbf{31}_W$ Pawn
31*a* base
31*b* seal
$\mathbf{31}_B$ Pawn
31*c* base
31*d* seal
$\mathbf{32}_W$ Rook
32*a* base
32*b* seal
$\mathbf{32}_B$ Rook
32*c* base
32*d* seal
$\mathbf{33}_W$ Knight
33*a* base
33*b* seal
$\mathbf{33}_B$ Knight
33*c* base
33*d* seal
$\mathbf{34}_W$ Bishop
34*a* base
34*b* seal
$\mathbf{34}_B$ Bishop
34*c* base
34*d* seal
$\mathbf{35}_W$ Queen
35*a* base
35*b* seal
$\mathbf{35}_B$ Queen
35*c* base

35*d* seal
36$_W$ King
36*a* base
36*b* seal
36$_B$ King
36*c* base
36*d* seal
38 cavity
39 first cavity
40$_W$ material
40$_B$ material
41 sensor
43 second cavity
45 pad
50 longitudinal axis
55 longitudinal axis

What I claim is:

1. A weighted chess piece, comprising:

a base having a first cavity and a second cavity therein, wherein said first cavity is filled with loose particles of metal and said second cavity contains an electronic sensor.

2. The weighted chess piece recited in claim 1 wherein said loose particles of metal are tungsten in powder form.

3. The weighted chess piece recited in claim 1 wherein said electronic sensor is a coil.

4. The weighted chess piece recited in claim 1 wherein said electronic sensor is a radio frequency identification (RFID) tag.

5. The weighted chess piece recited in claim 1 wherein said chess piece is made of wood.

6. The weighted chess piece recited in claim 1 wherein said chess piece is made of plastic.

7. The weighted chess piece recited in claim 1 wherein said chess piece is selected from the group consisting of King, Queen, Rook, Bishop, Knight and Pawn.

8. A set of weighted chess pieces, comprising a subset of white pieces and a subset of black pieces, where the white pieces are made of a first species of wood, and the black pieces are made of a second species of wood, where the two species of wood have different densities, wherein each of said white pieces is weighted with loose particles of metal of a first average particle size, and each of said black pieces is weighted with said loose particles of metal but of a second average particle size.

9. The set of weighted chess pieces of claim 8 wherein said first average particle size is smaller than said second average particle size.

* * * * *